US006193084B1

(12) United States Patent
Oliver

(10) Patent No.: US 6,193,084 B1
(45) Date of Patent: Feb. 27, 2001

(54) DOOR HINGE HANGER

(76) Inventor: John Walter Oliver, 19275 Stone Oak Pkwy. Apartment 611, San Antonio, TX (US) 78258

( * ) Notice: Subject to any disclaimer, the term of this patent is extended or adjusted under 35 U.S.C. 154(b) by 0 days.

(21) Appl. No.: 09/460,232

(22) Filed: Dec. 13, 1999

(51) Int. Cl.[7] ..... A47G 29/087
(52) U.S. Cl. ..... 211/119.004
(58) Field of Search ..... 211/119.004, 96, 211/87.01

(56) References Cited

U.S. PATENT DOCUMENTS 1,208,986 * 12/1916 Krodel .
2,487,652 * 11/1949 Heinrich .
3,175,696 * 3/1965 Milbourne .

* cited by examiner

*Primary Examiner*—Alvin Chin-Shue
*Assistant Examiner*—Sarah Purol
(74) *Attorney, Agent, or Firm*—Royston, Rayzor, Vickery, Novak & Druce, L.L.P.

(57) ABSTRACT

A support apparatus comprising a connector adapted to be releasably engageable upon a door hinge assembly. The support apparatus includes an attachment assembly coupled to the connector, with the attachment assembly configured for supporting articles to be suspended from the door hinge assembly. Adjustments of the attachment assembly include changes in configuration for supporting articles and variation in length where the attachment assembly is extendable and retractable.

23 Claims, 3 Drawing Sheets

DOOR HINGE HANGER

DESCRIPTION

1. Technical Field

The present invention relates generally to a support apparatus for storage and organization of a variety of articles, and more specifically to a hanger, having a plurality of points to attach articles when the hanger is mounted on a door hinge assembly.

2. Background Art

Many ways have been devised for organizing and storing objects both large and small. Commonly known structures utilized for storage and object organization include chests, drawers, closets, cupboards, bins and boxes. Materials used for manufacturing such storage structures include wood, metal, plastic and combinations of these and other materials. Some storage facilities are designed for storage of one type of objects, while other combinations of storage containers may be used to organize clothing, footwear, bed linens and bathroom linens in a convenient dedicated location. At least one manufacturer provides a collection of metal mesh components that interlock for the construction of wall units specifically intended for use as storage units.

Appropriate location of most conventional storage containers, such as chests of drawers, considers the most convenient placement for ready access, frequently with articles of different types being stored in distant locations for where the article's typical utilization occurs. A key organizer in the kitchen, for instance, is not necessarily a convenient or best location for the key to a locked cabinet in the garage. Similarly, after showering, ready access to a robe in the bathroom is more desirable than having to obtain such an item from a bedroom closet where other clothing is typically stored.

An organizer for small items that are used or gathered on a daily basis such as billfolds, wrist-watches, combs and other toiletry items would be advantageously positioned if near to where preparation for daily activity is made by the user. The need for rapid departure at the beginning of a work day frequently leads to anxiety due to a needed item having been mislaid. Such a situation establishes the need for an organizer nearby a location that is an essential part of a daily routine. The organizer should be sturdy enough to support a variety of objects, but especially those types of items frequently required during daily activities. Preferably, the capabilities and configuration of suitable organizing and storage structures allow flexibility so that the articles stored may change, e.g. with time of day or changes in daily routines. Additionally, the storage device should be small and sufficiently portable for convenient placement in multiple locations using similar installation techniques.

In view of the above described deficiencies associated with the use of known designs for organizing and storage devices; the present invention has been developed to alleviate these drawbacks and provide further benefits to the user. These enhancements and benefits are described in greater detail hereinbelow with respect to several alternative embodiments of the present invention.

DISCLOSURE OF THE INVENTION

The present invention in its several disclosed embodiments alleviates the drawbacks described above with respect to conventionally designed support apparatus and incorporates several additionally beneficial features for the user. As disclosed, the invention includes several versions of a support apparatus that attaches quickly and securely to a door or other suitable pinned hinge assembly. A support apparatus, according to the present invention, comprises a connector and an attachment assembly. The connector releasably couples the support apparatus to the hinge assembly, while the attachment assembly includes a variety of article supports and/or containers to hold articles for organization, storage and ready accessibility. The connector includes an orifice, looped or otherwise arcuate portion sized to releasably fit around the spindle of a hinge pin that establishes the axis of rotation for the hinge plates of a hinge assembly. As shown, installation of the support apparatus requires withdrawing or raising of the hinge pin sufficiently away from the balance of the hinge assembly to permit positioning the connector around the spindle portion of the hinge pin. Thereafter, when re-inserting the hinge pin into the hinge assembly or moving a partially withdrawn hinge pin back into it operational position, the flat head of the hinge pin contacts the connector to secure its location between the head portion of the hinge pin and the upper edge of the interlaced pin receiving portions of the hinge plates.

The beneficial effects described above apply generally to the exemplary devices and mechanisms disclosed herein of the support apparatus. The specific structures through which these benefits are delivered will be described in detail hereinbelow.

BRIEF DESCRIPTION OF THE DRAWINGS

The invention will now be described in greater detail in the following way of example only and with reference to the attached drawings, in which.

MODE(S) FOR CARRYING OUT THE INVENTION

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Figure 1:
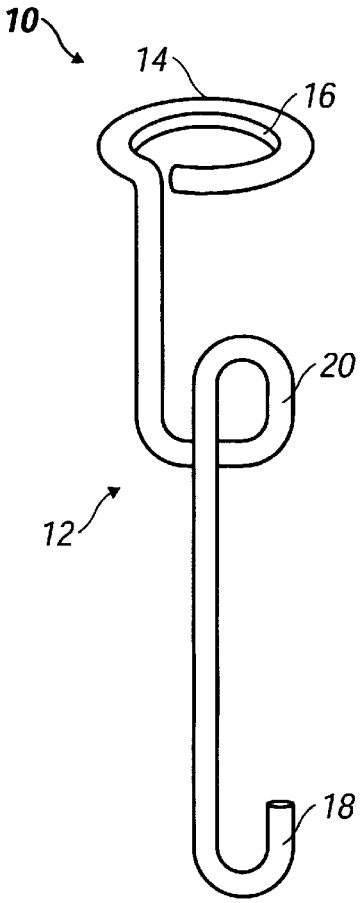
FIG. 1 is a side view of a support apparatus according to the present invention.

Referring to the figures, wherein like numbers refer to like parts throughout the several views, FIG. 1 is a side view of a support apparatus 10, according to the present invention, including an attachment assembly 12 and a ring-shaped connector 14 formed as a looped portion 1 6 of the support apparatus 10. The support apparatus 10 further includes a hook receiver 18 as an article support. Articles of clothing such as robes, shirts, towels, or the like, may be placed or draped over the hook receiver 18 for convenient storage. Since the hook receiver 18 may be used with wet towels or wet clothing, the support apparatus 10 may be constructed using a corrosion-resisting material or otherwise protected from corrosion by a suitable impervious coating. As depicted in FIG. 1, a support apparatus 10, according to the present invention, may be constructed from a single length of wire and optionally include a bent or wound section 20 to add flexibility to the attachment assembly 12 or provide stress relief to the structure.

Figure 2:
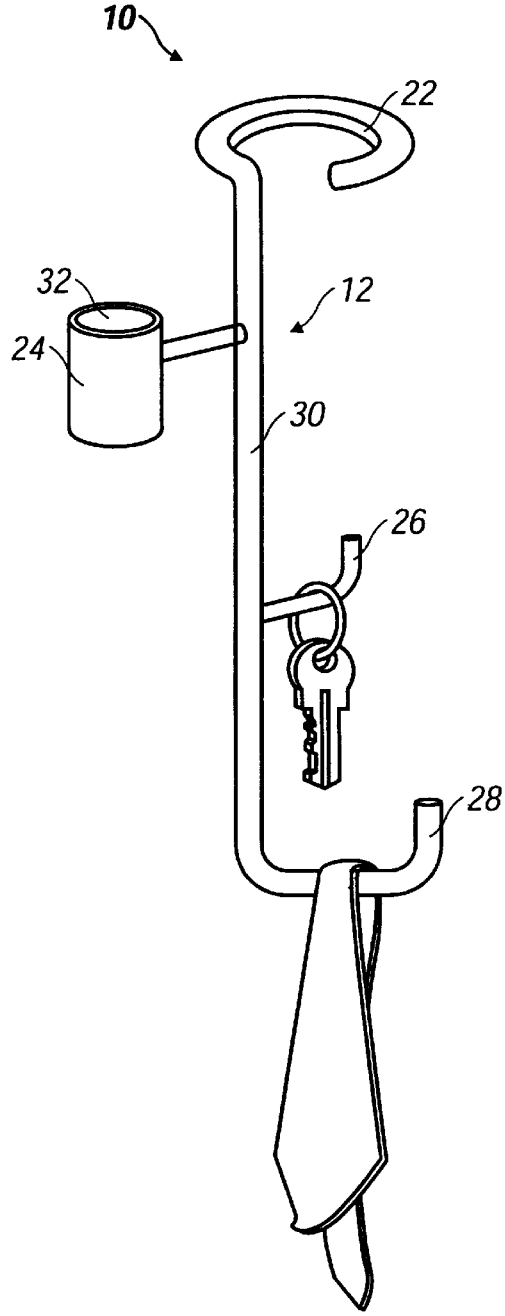
FIG. 2 shows a perspective view of a support apparatus according to the present invention, including optional attachments for use with the attachment assembly.

FIG. 2 illustrates several optional features that may be included with a support apparatus 10 constructed according to the teachings of the present invention. Comparing FIG. 2 to FIG. 1, the connector 14 has a slightly different configuration in that it includes a hooked portion 22 which leaves a gap in the connector 14 to facilitate releasable attachment of the support apparatus 10 to a door hinge assembly 40 (see FIG. 5). The attachment assembly 12 may include a combination of article supports, such as a pocket receiver 24, a support hook 26 and/or a tie hanger 28. The support apparatus 10 may include a plurality of one type of article support or a plurality of mixed types of article supports. Generally, individual article supports 18, 24,26,28 on the same support apparatus will be arranged to have an essentially vertical relationship relative to each other. Other possibilities exist, however, including the use of a plurality of article supports 18,24,26,28 attached at the same point of the main support or extension member 30 of the attachment assembly 12. As an example, necktie storage may use an article support positioned at one elevational location on the attachment assembly 12, but which includes a plurality of tie hangers 28, configured to accommodate the hanging of several ties from the same height. Alternatively, when the purpose of the attachment assembly 12 is simply necktie organization and storage, single tie hangers 28 may be individually positioned in a rung-like arrangement from the top to the bottom of the attachment assembly 12. Depending on the space available in the proximity of the door hinge assembly 40, several columns of support articles, e.g. tie hangers 28, could be arranged at every 90° around the perimeter of the main support 30.

Article supports 18,24,26,28, of the nature referred to herein take a variety of forms with only a limited number actually shown. In one embodiment of the present invention, the article support is a pocket receiver 24 that includes an interior space 32 suitable for storage of small items, such as coins, clips, combs and the like. In another version of the invention it may be desirable to use article supports in the form of support hooks 26 of various sizes to act as organizers of items, such as keys or watches that include parts such as key rings or straps that may be conveniently hung over a support hook 26. It is also considered that differently configured article supports may be used with a support apparatus 10 according to the present invention. The variety of types of article support is limited only by one's imagination.

Figure 3:
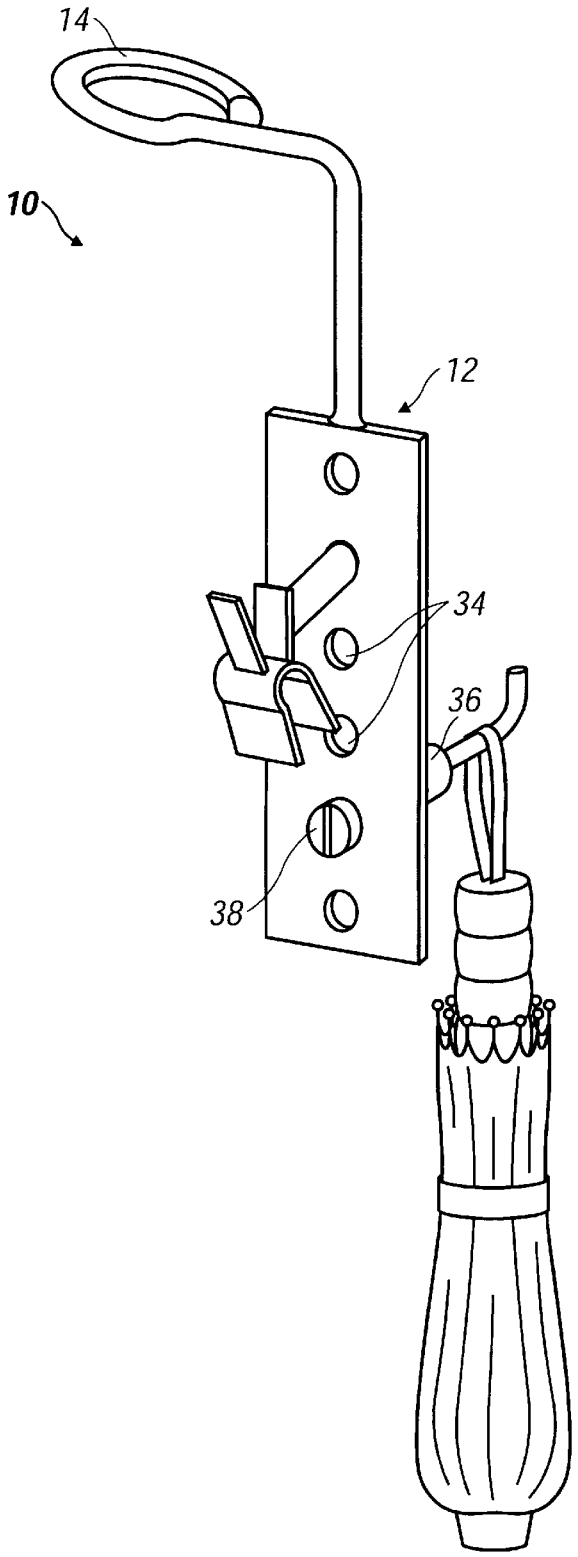
FIG. 3 is a perspective view of a support apparatus according to the present invention, having an attachment assembly including adjustable positioning of optional attachments.

FIG. 3 shows an attachment assembly 12 differing from earlier discussed concepts by providing alternative positioning of the article supports. The main support 30 may be a plate-like, elongate structure that includes support retainers 34 at various points along its length. As illustrated the support retainers 34 are in the form of receiving holes or a plurality of hook receivers 34 suitable for receiving an article support peg 36. The article support peg 36 may include a groove 38 to allow the peg to adjust to the hole size of a support retainer 34 providing frictional engagement therewith. Other forms of retainer 34 could replace the receiving hole 34 format. For example, an article support may include one part of a mechanical fastener which attaches to a mating part held by the main support 30. Suitable mechanical fasteners include hook and loop fasteners, press studs, and a variety of interlocking fastener types such as snap-halves, provided that upon formation of a mated connection, the article support has the strength needed to prevent collapse or disengagement under the weight of an attached article.

Figure 4:
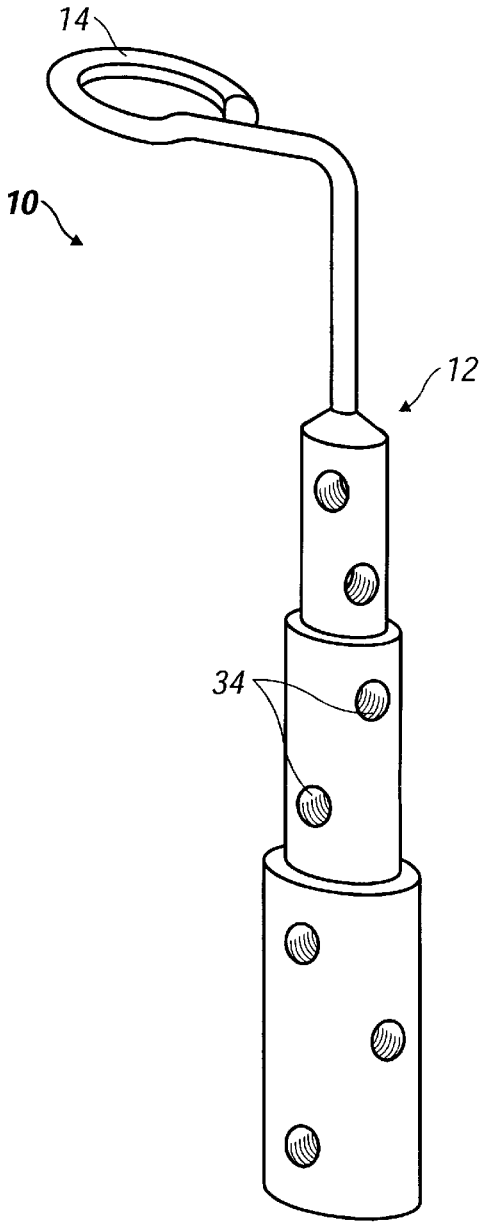
FIG. 4 shows a perspective view of a telescoping attachment assembly with adjustable positioning for optional attachments.

As another optional embodiment of the present invention, FIG. 4 shows a support apparatus 10 having a telescoping main support 30 for the attachment assembly 12. Such a design concept facilitates adjustment of the length of the attachment assembly 12 for accommodation of multiple articles that may vary in size. When the support apparatus is not in use, the main support 30 may be returned to its retracted condition wherein it occupies a minimum amount of space. The main support 30 includes support retainers 34 as points for attachment of articles supports. As illustrated, these support retainers 34 are in the form of holes but, as previously discussed, other forms of attachment would be equally effective.

Figure 5:
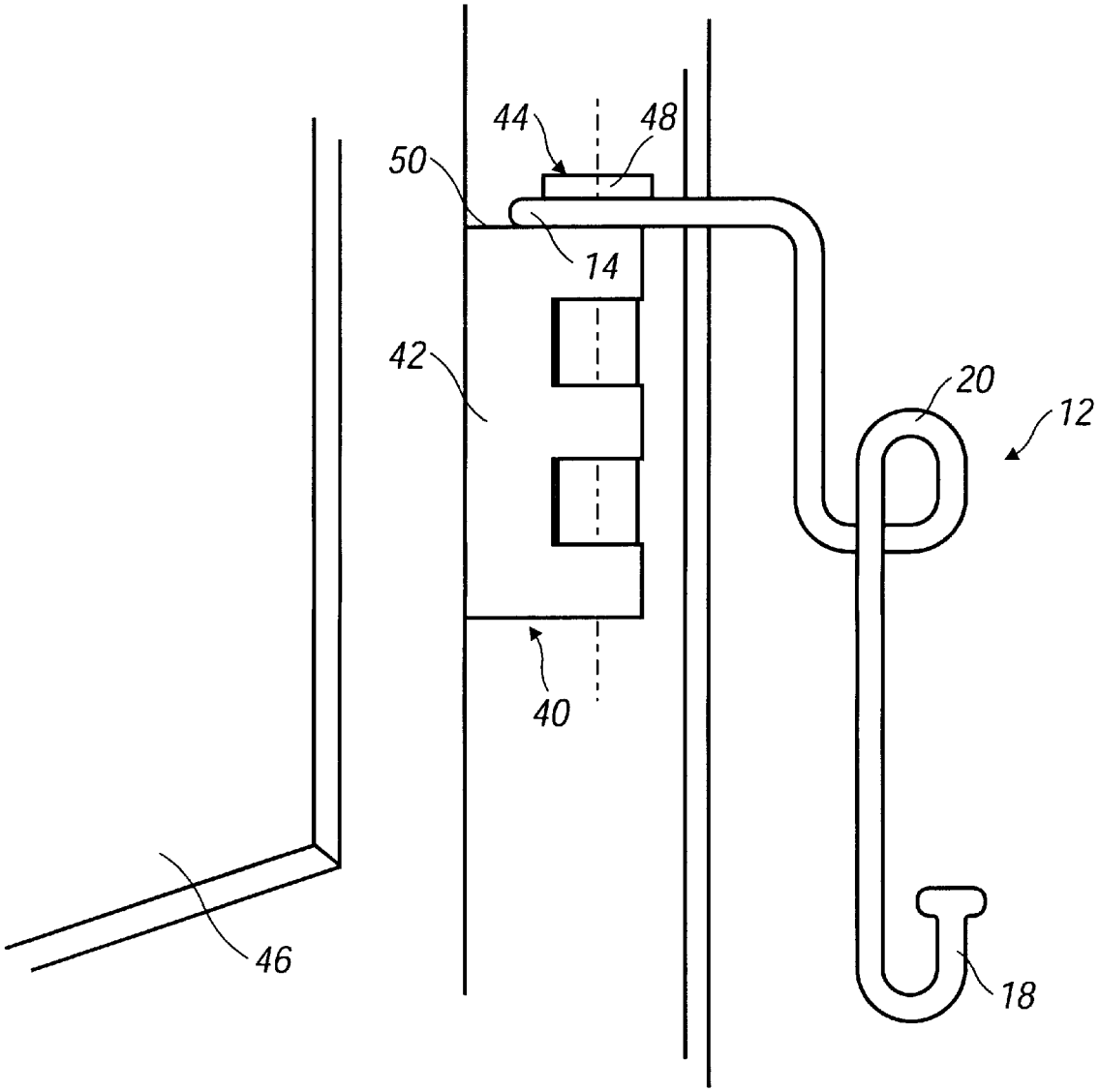
FIG. 5 provides an illustration of a door hinge assembly showing capture of a support apparatus, according to the present invention, using the connector clamped between the top of a hinge plate and the underside of the head of the hinge pin of the hinge assembly.

Before use, the support apparatus 10 must be connected to a door hinge assembly 40. FIG. 5 shows a typical door hinge assembly 40 that includes a pair of hinge plates 42 pivotally joined at interlaced portions, using a hinge pin 44 to provide an axis about which the plates 42 rotate. A support apparatus 10, similar to that shown in FIG. 1 may be releasably engaged to the hinge assembly 40 by withdrawing the hinge pin 44 from the channel or receiver formed by the interlacing segments of the pair of hinge plates 42. If the pin 44 is to be completely withdrawn, the door 46 should be supported during this operation. Usually, however, the pin 44 need only be elevated slightly out of the receiving channel. In either case, once the pin 44 has been either removed or slightly withdrawn, the looped portion 16 of the connector 14 that forms a part of the support apparatus 10 is installed for proper positioning over the spindle (not shown) of the hinge pin 44. In this arrangement, the connector 14 adopts a position wherein the spindle and the attachment assembly 12 align in essentially the same direction, usually vertical. With this orientation, the hinge pin 44 may be re-inserted into the channel formed by the hinge plates 42 to secure the hinge assembly 40 and clamp the connector 14 between the head 48 of the hinge pin 44 and upper edges 50 of the hinge plates 42 which allows the attachment assembly 12 to hang down from the hinge assembly 40.

There exists a danger of the hinge plates 42 separating if the hinge pin 44 is removed completely from a hinge assembly 40, as discussed above. Such separation brings with it the likelihood of the door 46 separating from the door frame. It may be desirable, therefore, to withdraw the hinge pin 44 only part of the way out of the channel it normally occupies. This is possible using the hooked portion 22 of the connector 14 shown in FIG. 2. Raising the hinge pin 44 sufficiently above the hinge assembly 40, provides a gap between the hinge plates 42 and the head 48 of the hinge pin 44 to allow the hooked portion 22 to slide into the gap with the hinge pin spindle centered in the hooked portion 22. Suitable pressure on thp head 48 of the hinge pin 44 causes downward movement causing a clamping of the support apparatus 10 thereby coupling it to the door hinge assembly 40.

A support apparatus and its components have been described herein. These and other variations, which will be appreciated by those skilled in the art, are within the intended scope of this invention as claimed below. As previously stated, detailed embodiments of the present invention are disclosed herein; however, it is to be understood that the disclosed embodiments are merely exemplary of the invention that may be embodied in various forms.

What is claimed and desired to be secured by Letters Patent is as follows:

1. A support apparatus comprising:

a connector adapted to be releasably engageable upon a door hinge assembly;

an attachment assembly coupled to said connector, said attachment assembly is configured for supporting articles to be suspended from the door hinge assembly and said attachment assembly includes an extension member adapted for receiving articles to be suspended thereupon; and at least one pocket receiver coupled to said extension member and each of said pocket receivers being adapted for receiving articles to be suspended from said door hinge assembly in an interior space of said pocket receiver.

2. The support apparatus as recited in claim 1 further comprising:

said connector having a hooked portion adapted to fit at least partially about a spindle portion of a hinge pin of the door hinge assembly and substantially under a head portion of the hinge pin of the door hinge assembly.

3. The support apparatus as recited in claim 1 further comprising:

said connector having a looped portion adapted to fit at least partially about a spindle portion of a hinge pin of the door hinge assembly and substantially under a head portion of the hinge pin of the door hinge assembly.

4. The support apparatus as recited in claim 1 further comprising:

said extension member adapted for extension and retraction with respect to a length thereof.

5. The support apparatus as recited in claim 1 said attachment assembly further comprising:

a plurality of pocket receivers coupled to said extension member and adapted for receiving articles to be suspended from said door hinge assembly in an interior space of said pocket receiver.

6. The support apparatus as recited in claim 5 wherein said plurality of pocket receivers are arranged in a series substantially vertically oriented.

7. The support apparatus as recited in claim 1, wherein said attachment assembly further comprises at least one hook receiver arranged thereupon for receiving draped cloth articles to be suspended from said door hinge assembly.

8. The support apparatus as recited in claim 1, wherein said attachment assembly further comprises a plurality of hook receivers arranged thereupon and each of said hook receivers being arranged to receive draped cloth articles to be suspended from said door hinge assembly.

9. The support apparatus as recited in claim 8 wherein said plurality of hook receivers are arranged in a series substantially vertically oriented.

10. The support apparatus as recited in claim 1 said attachment assembly further comprising:

at least one tie hanger coupled to said extension member and adapted for receiving thereupon a tie to be suspended from said door hinge assembly.

11. The support apparatus as recited in claim 1 said attachment assembly further comprising:

a plurality of tie hangers coupled to said extension member and each of said tie hangers adapted for receiving thereupon a tie to be suspended from said door hinge assembly.

12. The support apparatus as recited in claim 11 wherein said plurality of tie hangers are arranged in a series substantially vertically oriented.

13. The support apparatus as recited in claim 1 said attachment assembly further comprising:

at least one article support coupled to said extension member and adapted for receiving thereupon an article to be suspended from said door hinge assembly.

14. The support apparatus as recited in claim 13 further comprising:

said at least one article support being releasably coupled to said extension member for variable positioning of said at least one article support along at least a portion of a length of said extension member.

15. The support apparatus as recited in claim 1 said attachment assembly further comprising:

a plurality of article supports coupled to said extension member and each of said article supports adapted for receiving thereupon an article to be suspended from said door hinge assembly.

16. The support apparatus as recited in claim 15 wherein said plurality of article supports are arranged in a series substantially vertically oriented.

17. The support apparatus as recited in claim 1 wherein said support apparatus is constructed from a single continuous length of wire.

18. The support apparatus as recited in claim 17 wherein said support apparatus constructed from a single continuous length of wire is at least partially encased in a moisture impermeable coating for avoiding corrosion of said length of wire.

19. A support apparatus comprising:

a connector adapted to be releasably engageable upon a door hinge assembly;

an extension member coupled to said connector, said extension member configured for supporting articles to be suspended from the door hinge assembly; and said extension member configured to extend and retract with respect to a length thereof.

20. The support apparatus as recited in claim 19, wherein said extension member is configured to be substantially vertically oriented when suspended from a door hinge assembly.

21. A support apparatus comprising:

a connector adapted to be releasably engageable upon a door hinge assembly; and an extension member coupled to said connector, said extension member configured for supporting articles to be suspended from the door hinge assembly: and at least one single tie hanger coupled to said extension member and adapted for receiving thereupon a single tie to be suspended from said door hinge assembly.

22. A support apparatus comprising:

a connector adapted to be releasably engageable upon a door hinge assembly; and an extension member coupled to said connector, said extension member configured for supporting articles to be suspended from the door hinge assembly; and said connector and said extension member being constructed from a single length of wire and said extension member including a wound section in a substantially vertically oriented portion thereof for providing stress relief to said support apparatus.

23. The support apparatus as recited in claim 22 wherein said single length of wire is at least partially encased in a moisture impermeable coating for avoiding corrosion of said length of wire.

* * * * *